US008800514B2

(12) United States Patent
Boese et al.

(10) Patent No.: US 8,800,514 B2
(45) Date of Patent: Aug. 12, 2014

(54) CAMSHAFT ADJUSTER

(71) Applicant: Schaeffler Technologies AG & Co. KG, Herzogenaurach (DE)

(72) Inventors: Olaf Boese, Nuremberg (DE); Mario Arnold, Aurachtal (DE); Christian Bosel, Rednitzhembach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/794,909

(22) Filed: Mar. 12, 2013

(65) Prior Publication Data

US 2013/0247852 A1 Sep. 26, 2013

(30) Foreign Application Priority Data

Mar. 23, 2012 (DE) ..... 10 2012 204 726

(51) Int. Cl.
*F01L 1/34* (2006.01)

(52) U.S. Cl.
USPC ..... 123/90.17; 123/90.31

(58) Field of Classification Search
USPC ..... 123/90.15, 90.17, 90.31
See application file for complete search history.

(56) References Cited

U.S. PATENT DOCUMENTS 7,363,897 B2 * 4/2008 Fischer et al. ..... 123/90.17
2009/0188456 A1 * 7/2009 Dupuis et al. ..... 123/90.17

FOREIGN PATENT DOCUMENTS

DE 102009054048 5/2011

* cited by examiner

*Primary Examiner* — Zelalem Eshete
(74) *Attorney, Agent, or Firm* — Volpe and Koenig, P.C.

(57) ABSTRACT

A camshaft adjuster (1) is provided that has a drive element (2), a driven element (3), and at least one side cover (5). The side cover (5) has, for supporting a spring (4), several screw bosses (6) that are penetrated by screws (7) that are provided for a rotationally locked connection between the side cover (5) and the drive element (2) or the driven element (3).

10 Claims, 3 Drawing Sheets

CAMSHAFT ADJUSTER

INCORPORATION BY REFERENCE

The following documents are incorporated herein by reference as if fully set forth: German Patent Application No. 102012204726.3, filed Mar. 23, 2012.

FIELD OF THE INVENTION

The invention relates to a camshaft adjuster.

BACKGROUND

Camshaft adjusters are used in internal combustion engines to vary the control timing of the combustion chamber valves, in order to be able to variably shape the phase relation between a crankshaft and a camshaft in a defined angular range between a maximum advanced position and a maximum retarded position. The adaption of the control times to the current load and rotational speed reduces consumption and emissions. For this purpose, camshaft adjusters are integrated in a drive train by which torque is transmitted from the crankshaft to the camshaft. This drive train can be formed, for example, as a belt drive, chain drive, or gearwheel drive.

In a hydraulic camshaft adjuster, the driven element and the drive element form one or more pairs of pressure chambers that act in opposite directions and can be pressurized with hydraulic medium. The drive element and the driven element are arranged coaxially. By filling and emptying individual pressure chambers, a relative movement between the drive element and the driven element is generated. The spring causing a rotating effect between the drive element and the driven element forces the drive element in a preferred direction relative to the driven element. This preferred direction can be in the same direction or in the opposite direction relative to the direction of rotation.

One type of hydraulic camshaft adjuster is the vane cell adjuster. The vane cell adjuster has a stator, a rotor, and a drive wheel with external teeth. The rotor is formed as a driven element and can be locked in rotation usually with the camshaft. The drive element includes the stator and the drive wheel. The stator and the drive wheel are locked in rotation with each other or are alternatively formed integrally with each other. The rotor is arranged coaxial to the stator and within the stator. With their vanes extending in the radial direction, the rotor and the stator form oil chambers that act in opposite directions and can be pressurized with oil pressure and allow a relative rotation between the stator and the rotor. The vanes are formed either integrally with the rotor or the stator or arranged as "inserted vanes" in grooves provided for this reason in the rotor or the stator. The vane cell adjusters also have various sealing covers. The stator and the sealing covers are secured with each other by several threaded connections.

Another type of hydraulic camshaft adjuster is the axial piston adjuster. Here, a displacement element is displaced in the axial direction by oil pressure. This displacement element generates a relative rotation between a drive element and a driven element via helical gearing.

Another type of a camshaft adjuster is the electromechanical camshaft adjuster that has a triple-shaft gear (for example, a planetary gear). Here, one of the shafts forms the drive element and a second shaft forms the driven element. Using the third shaft, rotational energy can be fed to the system or discharged from the system by an adjustment device, for example, an electric motor or a brake. There can also be a spring that increases or decreases the relative rotation between the drive element and the driven element.

DE 10 2009 054 048 A1 shows a camshaft adjuster for a belt drive that has a side cover locked in rotation with a screw with the drive element. For the screw, the side cover has internal threading. So that sufficient thread turns of the internal thread can be formed for the screw, the side cover is enlarged in the axial direction in the area of the internal thread. The spring is arranged on the side of the camshaft adjuster away from the camshaft.

SUMMARY

The objective of the present invention is to provide a camshaft adjuster that has an especially simple spring mounting.

This objective is met using one or more features of the invention.

A camshaft adjuster with a drive element, a driven element, a spring, and a side cover, wherein the components noted above are arranged coaxial to the rotational axis of the camshaft adjuster, the drive element and the driven element are arranged so that they can rotate relative to each other, the spring tensions the drive element and the driven element in the peripheral direction, the side cover is locked in rotation with the drive element or the drive element is locked in rotation by a screw, the side cover has a screw boss that is penetrated by the screw, which meets the objective according to the invention in that the screw boss is formed as a support that supports the spring, especially one end of the spring. Several screw bosses can support, in addition to supporting the spring ends, also the winding bodies and thus the entire spring.

In this way it is achieved that especially for thin-walled side covers, the screw boss is simultaneously realized for holding the screw and for holding an end of the spring. Consequently, the installation space is used more efficiently and extra costs in production are avoided.

As the camshaft adjuster, advantageously a hydraulic camshaft adjuster, in particular a vane cell adjuster, is considered. With their vanes extending in the radial direction, the driven element and the drive element form oil chambers that act opposite each other and can be pressurized by oil pressure and allow a relative rotation between the drive element and the driven element. The vanes are formed either integrally with the driven element or the drive element or arranged as "inserted vanes" in grooves provided for this purpose in the driven element or the drive element. The vane cell adjusters also have various sealing covers or side covers. The drive element and the side covers are secured with each other locked in rotation by several threaded connections.

The screw boss has a cylindrical outer peripheral surface on which the end of the spring is supported. The screw boss also does not have to have an opening going all the way through for the screw, but could also have a pocket hole for one end of the screw.

In one construction of the invention, the screw boss is arranged in parallel to and with a radial spacing relative to the rotational axis of the camshaft adjuster. For the efficient support of one spring end, especially for springs with radial winding bodies, a greater spacing relative to the rotational axis of the camshaft adjuster is advantageous. Such springs also save a lot of space in the axial direction, wherein the screw boss can be adapted to the wire thickness of the spring.

In one advantageous construction, the screw boss is formed integrally with the side cover. For a side cover made from sheet metal, an integral screw boss can be advantageously easily formed by a deep-drawing process or other shaping processes. If the side cover is made from plastic, molding methods, especially injection molding methods, are also possible. The screw boss itself does not have to have an opening going all the way through for the screw, but instead could also have a pocket hole for one end of the screw.

In one construction of the invention, the screw boss is completely penetrated by a screw shaft of the screw. The inner diameter of the screw boss advantageously guides the screw during the joining process, so that the thread of the screw engages with a complementary thread of another side cover or the drive element or the driven element.

In one preferred construction, the screw boss is formed as a socket and connected to the side cover with a positive fit, non-positive fit, or material fit connection. The socket is formed separate from the side cover and pressed, swaged, screwed, welded, bonded, or soldered to the side cover. Depending on the type of fastening mentioned above, the joint can be paired, from one peripheral surface of the socket, with a peripheral surface, e.g., a drilled hole of the side cover or paired, from an end face of the side cover, with an end face of the side cover. The socket does not have to have an opening that goes all the way through for the screw, but instead could also have a pocket hole for one end of the screw.

In one construction of the invention, the socket projects completely or partially through the side cover. Advantageously, for the rotationally locked connection between the socket and the side cover, various non-rotationally symmetric pairs of shapes in the outer periphery of the socket can be used with the inner periphery of the side cover. For example, polygonal or non-circular cross sections are suitable for such a rotationally locked connection.

In one advantageous construction, the socket projects through both the side cover and also the drive element or the driven element with which the side cover is locked in rotation. The socket thus can guide the entire screw during the joining process by means of the inner diameter of the socket and can simultaneously hold a spring end of the spring by the outer diameter of the socket.

Alternatively, the socket could have an inner diameter that is provided for engaging with the outer diameter of the screw.

In another construction of the invention, the rotationally locked connection between the side cover and the drive element or the driven element is realized by means of the socket. Advantageously, the socket itself is used for the positive fit element with which the side cover is locked in rotation to the drive element or the driven element. The side cover and the drive element or the driven element have inner periphery profiles that are complementary to the outer periphery of the socket.

In one advantageous construction, the rotationally locked connection between the side cover and the drive element or the driven element is realized by the screw boss in that the screw boss penetrates the drive element or the driven element. Advantageously, the screw boss itself is used for the positive fit element with which the side cover is locked in rotation to the drive element or the driven element. The drive element or the driven element has inner periphery profiles that are complementary to the outer periphery of the screw boss.

In one especially preferred construction, the screw boss is formed as a contact for the screw head, wherein the diameter of the screw boss is smaller than the diameter of the enveloping cylinder surface of the screw head, wherein axial fixing of the end of the spring is formed. Different screw heads can be provided for the axial fixing, as long as the screw head projects past the spring wire in the radial direction.

Through the construction of the screw boss of a side cover of the camshaft adjuster according to the invention, a space-saving arrangement is achieved for the rotationally locked connection between the side cover and the drive element or the driven element by means of a screw and simultaneously a bearing for a spring end of the spring that tensions the drive element relative to the driven element in the peripheral direction.

BRIEF DESCRIPTION OF THE DRAWINGS

Embodiments of the invention are shown in the figures. Shown are.

DETAILED DESCRIPTION OF THE PREFERRED EMBODIMENTS

Figure 1:
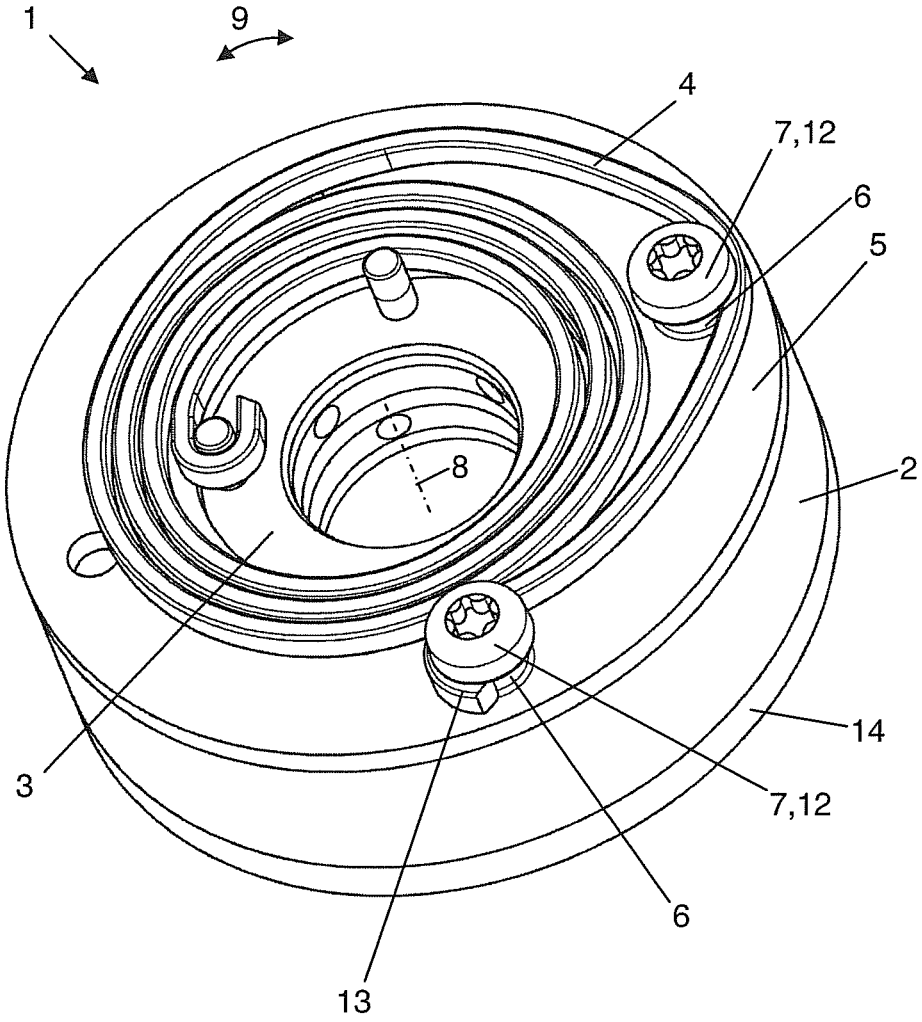
FIG. 1 is a perspective view of a camshaft adjuster.

FIG. 1 shows a camshaft adjuster 1 in a perspective view.

The camshaft adjuster 1 is formed as a vane cell adjuster and has a driven element 3 and a drive element 2. With their vanes extending in the radial direction, the driven element 3 and the drive element 2 form oil chambers that act opposite each other and can be pressurized by oil pressure and allow a relative rotation in the peripheral direction 9 between the drive element 2 and the driven element 3. The vanes are formed either integrally with the driven element 3 or the drive element 2 or arranged as "inserted vanes" in grooves provided for this purpose in the driven element 3 or the drive element 2. The vane cell adjusters also have various sealing covers or side covers 5 and 14. The drive element 2 and the side covers 5 and 14 are locked in rotation with each other by several screws 7. The side cover 5 is formed as an annular disk.

The camshaft adjuster 1 is locked in rotation with a camshaft. On the side of the camshaft adjuster 1 away from the camshaft, the side cover 5 is arranged with two screw bosses 6. The screw bosses 6 are formed integrally with the side cover 5 and in the shape of collars. Each screw boss 6 is penetrated by a screw 7. The screw bosses 6 support a spring 4 arranged on this side of the camshaft adjuster 1 away from the camshaft. One end 13 of the spring 4 wraps around one screw boss 6, wherein, in contrast, the other screw boss 6 supports the winding body of the spring 4. The outer diameter of the screw heads 12 of the screws 7 is larger than the outer diameter of the screw bosses 6, wherein axial fixing of the spring end 13 and the spring 4 is achieved.

Figure 2:
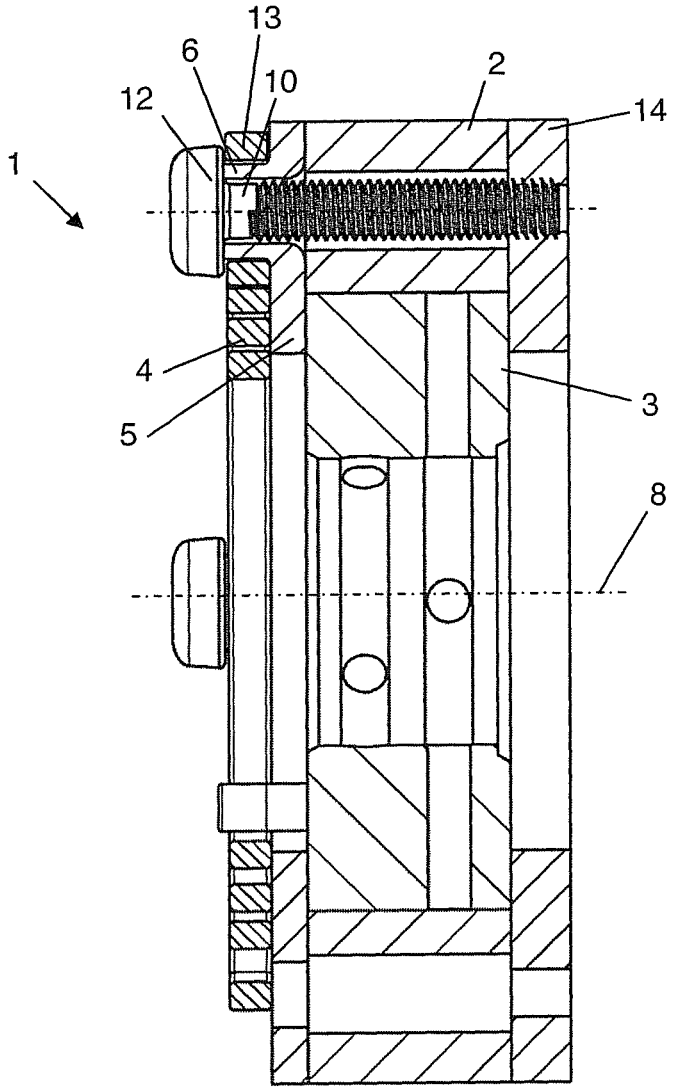
FIG. 2 is a view of a first embodiment according to the invention with a screw boss formed integrally with the side cover.

FIG. 2 shows a first embodiment according to the invention with a screw boss 6 formed integrally with the side cover 5. The construction of the camshaft adjuster 1 is already described in FIG. 1. The screw boss 6 formed as a collar in the side cover 5 can be seen easily. The side cover 14 has an internal thread aligned with the axis of symmetry of the screw boss 6, wherein the screw 7 can engage in this internal thread and both secures the connection in the axial direction and also forms a rotationally locked connection between the side covers 5 and 14 with the drive element 2. The screw head 12 is supported on the end side of the screw boss 6. Advantageously, longer screws 7 can be used, wherein the biasing force decreases due to the increased expansion length of the screw 7. A reduced biasing force or the high expansion length can better equalize setting losses, wherein a more reliable connection is formed. Through the collar-shaped and thin-walled construction of the screw boss 6, the resulting flexibility of the screw boss 6 also contributes to reducing the biasing force. The spring 4 is also held by the outer diameter of the screw boss 6 or the screw bosses 6. As in FIG. 1, the outer diameter of the screw head 12 has a radial overlap relative to the spring wire of the spring 4, wherein this overlap fixes the spring 4 in the axial direction. Advantageously, the side cover 5 is made from sheet metal, wherein the screw boss 6 can be formed by a deep-drawing process. The side cover 14 can also have a screw boss, in order to increase the number of thread turns engaged with the screw 7. In such a construction, the side covers 5 and 14 can advantageously have the same shape.

Figure 3:
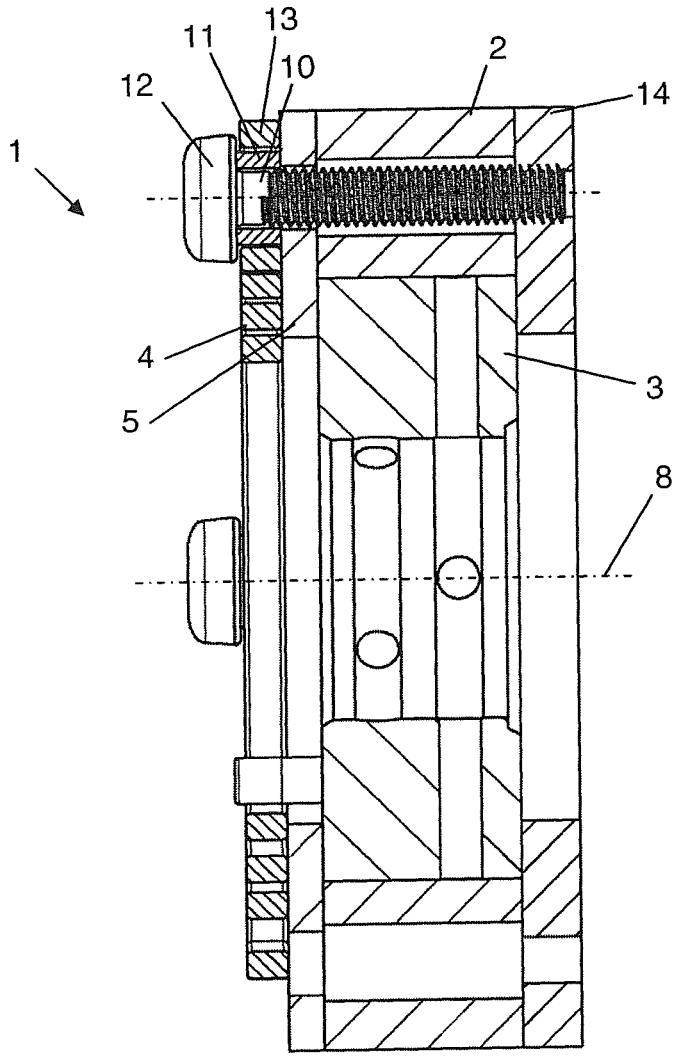
FIG. 3 is a view of a second embodiment according to the invention with a socket formed separate from a side cover.

FIG. 3 shows a second embodiment according to the invention with a socket 11 formed separate from a side cover 5. The inner diameter of the socket 11 can be adapted to the outer diameter of the screw shaft 10 of the screw 7, so that the screw 7 is guided by the socket 11 during the joining process. The socket 11 is in contact with the side cover 5 with its end side. The socket 11 can already be connected rigidly to the side cover 5 without the mounted screw 7 or can come in contact with the side cover 5 as a loose component first with the screw 7.

Advantageously the side cover 5 and the socket 11 are made from sheet metal. The side cover 14 can also have a screw boss, in order to increase the number of thread turns engaged with the screw 7. In such a construction, the side covers 5 and 14 can advantageously have the same shape.

As a component separate from the side cover 5, the socket 11 can have a material that is different from the side cover 5. In addition, the socket 11 can be coated for minimizing the wear of the spring contact and/or can be hardened separate from the side cover 5.

Due to the construction of an annular disk-shaped side cover 5, as in FIGS. 1 to 3, the screw bosses 6 or sockets 11 formed as the spring contact with the screws 7 have a large spacing relative to the axis of rotation 8 of the camshaft adjuster 1.

LIST OF REFERENCE NUMBERS

1) Camshaft adjuster
2) Drive element
3) Driven element
4) Spring
5) Side cover
6) Screw boss
7) Screw
8) Rotational axis
9) Peripheral direction
10) Screw shaft
11) Socket
12) Screw head
13) Spring end
14) Side cover

The invention claimed is:

1. A camshaft adjuster comprising:
a drive element, a driven element, a spring, and a side cover,
the drive element, the driven element, the spring, and the side cover are arranged coaxial to a rotational axis of the camshaft adjuster,
the drive element and the driven element are arranged to rotate relative to each other,
the spring tensions the drive element and the driven element in a peripheral direction,
the side cover is locked in rotation with the drive element or the driven element by a screw that includes a radially enlarged screw head,
the side cover has a screw boss that is penetrated by the screw,
the screw boss is formed as a support that supports the spring, and the screw head provides an axial stop for the spring.

2. The camshaft adjuster according to claim 1, wherein the screw boss is arranged parallel to and at a radial spacing to the rotational axis of the camshaft adjuster.

3. The camshaft adjuster according to claim 1, wherein the screw boss is formed integrally with the side cover.

4. The camshaft adjuster according to claim 1, wherein the screw boss is penetrated by a screw shaft of the screw.

5. The camshaft adjuster according to claim 1, wherein the screw boss is formed as a socket and is connected to the side cover with a positive fit, non-positive fit, or material fit connection.

6. The camshaft adjuster according to claim 5, wherein the socket penetrates the side cover.

7. The camshaft adjuster according to claim 5, wherein the socket penetrates both the side cover and also the drive element or the driven element with which the side cover is locked in rotation.

8. The camshaft adjuster according to claim 7, wherein the rotationally locked connection between the side cover and the drive element or the driven element is formed by the socket.

9. The camshaft adjuster according to claim 1, wherein a rotationally locked connection between the side cover and the drive element or the driven element is formed by the screw boss, which penetrates the drive element or the driven element.

10. The camshaft adjuster according to claim 1, wherein the screw boss is formed as a contact for the screw head, and a diameter of the screw boss is smaller than a diameter of an enveloping cylinder surface of the screw head.

* * * * *